United States Patent [19]

Niedermeyer

[11] 4,339,088

[45] Jul. 13, 1982

[54] EMBOSSING METHOD TO AVOID NESTING IN CONVOLUTELY WOUND ROLLS AND PRODUCT

[75] Inventor: William P. Niedermeyer, Green Bay, Wis.

[73] Assignee: Paper Converting Machine Company, Green Bay, Wis.

[21] Appl. No.: 137,599

[22] Filed: Apr. 7, 1980

[51] Int. Cl.[3] ..... B65D 85/67; B65D 85/671; B31B 1/14

[52] U.S. Cl. ..... 242/1; 156/209; 206/389; 493/321

[58] Field of Search ..... 206/389, 412; 242/1; 156/209, 219, 291, 292; 493/321

[56] References Cited

U.S. PATENT DOCUMENTS

| | | | |
|---|---|---|---|
| 2,023,357 | 12/1935 | Haryey | 206/389 |
| 3,016,137 | 1/1962 | Pollock | 242/1 |
| 3,380,580 | 4/1968 | Warp | 242/1 |
| 3,672,950 | 7/1972 | Murphy et al. | 156/209 |
| 3,867,225 | 2/1975 | Nystrand | 156/219 |
| 4,181,068 | 1/1980 | Pollock | 493/321 |

*Primary Examiner*—William T. Dixson, Jr.
*Attorney, Agent, or Firm*—Tilton, Fallon, Lungmus & Chestnut

[57] ABSTRACT

An embossing method to avoid nesting in convolutely wound rolls and product wherein the repeat length is at least as great as the roll circumference.

17 Claims, 8 Drawing Figures

ZERO 1 11 31 42 71 101

EMBOSSING METHOD TO AVOID NESTING IN CONVOLUTELY WOUND ROLLS AND PRODUCT

BACKGROUND OF THE INVENTION

This invention relates to a method of embossing in convolutely wound rolls to avoid nesting and the product resulting therefrom. Exemplary of the products produced according to the invention are household toweling and toilet tissue.

For many years, the problem of pattern "nesting" has been recognized as being contrary to the objective of obtaining maximum bulk and roll diameter for a specific sheet count and roll footage. The phenomenon of nesting applies to all roll products produced heretofore and vis-a-vis, sanitary roll products like toweling or bathroom tissue, many different patterns and techniques have been developed in order to avoid nesting. The problem still persists despite development of patterns that have undulating "sine waves", randomized patterns, different sized elements, and different sized pattern repeats. This difficulty has frustrated the achievement of the desired bulk which has been considered advantageous not only from the aesthetic point but also has provided certain manufacturing efficiencies.

For the sake of description, pattern repeat is the same as pattern sketch size and represents a specific length of pattern that is unique onto itself albeit it may contain the plurality of elements which are identical. For example, a plurality of identical elements can be laid out and subsequently engraved on embossing rolls, such that in a given "sketch repeat", elements that are aligned in both the MD ("machine direction") and CD ("cross machine directions") but spaced apart ⅛" would have a sketch repeat of ⅛".

In other arrangements, the same plurality of elements can be skewed along diagonal or undulating "sine wave" lines such that the repeat can be practically any length, and if they were laid out in a sine wave pattern, the sketch repeat would represent the pitch length of the sine curve as it progresses from a central reference to one side, crosses at inflection, continues past the mid point and finally returns to the same center line. This would be the pitch length of a sine wave having a plurality of common elements.

Pursuing the solution to this problem has thus far been a never-ending one. For example, U.S. Pat. No. 4,181,068 recognizes the problem and states "in order to preserve the desired structure and absorption characteristics in the paper towels, it is desirable to prevent the bulk characteristics of the towels from being deformed". This patent describes elements placed symmetrically about a center line that forms a helix of about 5 degrees relative to the MD. However this approach does not avoid the twin problems of embossment nesting and embossment breakdown.

There are numerous examples of commercially available products wherein the elements themselves or their placement have been randomized in order to prevent nesting, but as described more completely herein, these attempts have fallen short of a true solution to the problem. To understand why a truly non-nested convolutely wound roll has not been developed, a brief history of embossing is set forth.

Referring to the time frame of the 1950's and early 1960's, it was common practice to emboss with a male or female engraved steel roll bearing against a paper roll which ultimately wore into the same pattern and formed a close full contact nip between said rolls. Because paper rolls were subject to wear, they would, at the outset, be sized approximately 0.060" over the true pitch diameter of the steel engraved roll. The normal operating range was from 0.060" over the diameter of the engraved roll to minus 0.060" under sized. This limited operating range dictated expensive roll change rather frequently. In addition, and because of heavy nip pressures there was theory that due to the resiliency in the paper filling, a small upward deformation was always present just before the nip. When speeds increased beyond the limit of paper resiliency, this deformation or hump passed through the nip, setting up violent chattering of the roll and destruction of the pattern formed in the paper filling. In essence, a paper-steel combination presented a speed limitation in production. It should also be noted that because of the difficulty of running the pattern into the paper roll, pattern depth was generally limited to a range of 0.030"–0.035" to avoid excessive run in time and "scrubbing" of the pattern by interaction between the steel and paper rolls—this being a function of element shape, the angle of the element side wall and numerous other factors.

To avoid speed and replacement problems, matched steel engraved rolls entered the scene. In effect, the first roll is made from a mated tool or die (male or female) and substantial mechanical pressures are used to develop the pattern on the surface of the first steel roll, sometimes in combination with chemical etching. When the first or "conventional" roll was made, the second roll was generated by carefully controlling the chemical etching process and in essence, eating minute amounts of metal away until the surface of the second roll would perfectly mate with the first roll. If the first roll were male or cameo, the second roll would be female or intaglio.

With the development of steel-to-steel engraved rolls and their use in production, normally just ahead of a roll rewinder, there was still concern with substantially incompressible paper wads or other foreign matter being carried by the web through the nip causing instantaneous deflection, instantaneous recovery and damage when mating roll surfaces contacted. To avoid this, steel-to-steel rolls are commonly run with a minimum 0.010" clearance, but since the paper itself, especially one-ply is normally in the range of 0.005", the use of steel-to-steel rolls prompted development of deeper patterns—often in the range of from 0.035" to as high as 0.070" or above.

Recognizing the fragile nature of single ply tissue, or even two-ply tissue and toweling, and especially in view of the stock used, for example ground wood or short fibers, etc., the general trend toward larger elements was somewhat counter productive depending on the ability of the paper webs to sustain embossments during the wind up process. With larger elements, steeper element sidewalls became necessary, and in the female roll (first or second roll), this resulted in deeper grooves which can easily build up and pack with paper dust forcing periodic shutdown and arduous roll cleanup.

The larger elements also were more prone to failure when they were wound in a convolutely-wound roll simply because they would not sustain the next one or two convolutions of paper. At this point it is noted that a certain amount of web tension was necessary between an embosser and the rewound roll in order to avoid excessive wrinkles, and this necessary tension caused deeper, larger elements to collapse under the influence of outer convolutions.

Recognizing this problem, it might be thought that if an embossed web would perfectly nest throughout the wind, the upper embossment would be nested within the underlying embossment and thus be protected from damage by subsequent convolutions of wound product. However, to produce this effect, relatively small pattern sketches would to be used at the beginning of the wind and the "sketch repeat" would have to become progressively larger to account for diameter buildup. Thus, the circumference of a matched steel roll would have to be greater than the total footage in the wound roll, for example, a typical product, 187.5 lineal feet would dictate a roll diameter of 59.68" (almost six feet)—a totally unacceptable solution.

The other solution was to randomize pattern with different element shapes, or arrange a plurality of similar elements in randomized layout. However, according to present practice, and reference newly issued U.S. Pat. No. 4,181,068 it will be seen that because of the engraving process and the tooling thus far developed, pattern repeats currently used are limited in the range from as small as 0.0625" to as high as 5.0", and these repeats cannot be made to avoid sequential nesting and non-nesting throughout the normal roll buildup. Relative to single or two-ply tissue or toweling, the phenomenon of nesting/non-nesting throughout the roll buildup occurs. Where the larger, deeper elements are non-nested, failure occurs in zones adjacent to the nested portion for several reasons—the significant one being the continued advancement of any given pattern as the roll is wound and its tendency to "climb out of" the nested condition.

In recent years, and in recognition of the inability to generate maximum bulk, there has been a substantial trend toward laminated two or three ply toweling produced according to U.S. Pat. Nos. 3,337,388, 3,414,459, 3,961,119, and co-owned U.S. Pat. No. 3,867,225. These laminating techniques are effective on heavier weight two-ply toweling, but are not well adapted to light weight single or two-ply tissue products because the adhesive migrates rapidly through one or both plies at the point of application, thus fouling the co-acting embossing rolls. The invention does not involve laminating techniques and thus avoids the maintenance problem as well as the cost of adhesive.

The invention was prompted by the phenomenon of nesting/non-nesting and the resultant destruction of embossments in the wound roll first appeared in about 1977 in rolls produced in a Canadian mill. The toilet tissue web was embossed with a pattern using sequential and series male-female elements each about 0.1875"×0.1875" (3/16") with a sketch repeat of 0.375" (3/18"). Collapsing of embossments and degradation of the product was very apparent, but the failure of embossments (consisting of variable pluralities) occurred at various distances from the core in an unpredictable and non-related fashion. Despite efforts to control tension more accurately, the random failure of a variable plurality of embossments continued. This led to the investigation set forth hereinafter with the ultimate discovery of the inventive solution to the problem.

SUMMARY OF INVENTION

It has been discovered that arranging the repeat sketch with a length at least equal to or greater than the roll circumference is advantageous in avoiding nesting, maximizing bulk and avoids degradation of the embossments.

DETAILED DESCRIPTION

The invention is described in conjunction with the accompanying drawing, in which FIGS. 1 and 1A (2 sheets) represent a sequence of photographs reflecting the positions of various embossment nodes according to the experimentation performed according to Example I;

In an effort to investigate the causes for nesting/non-nesting and embossment degradation in a variable and unpredicatable fashion, the following experimentation was performed to see if a phenomenon similar to that experienced in the Canadian mill could be developed.

EXAMPLE I

Figure 1:
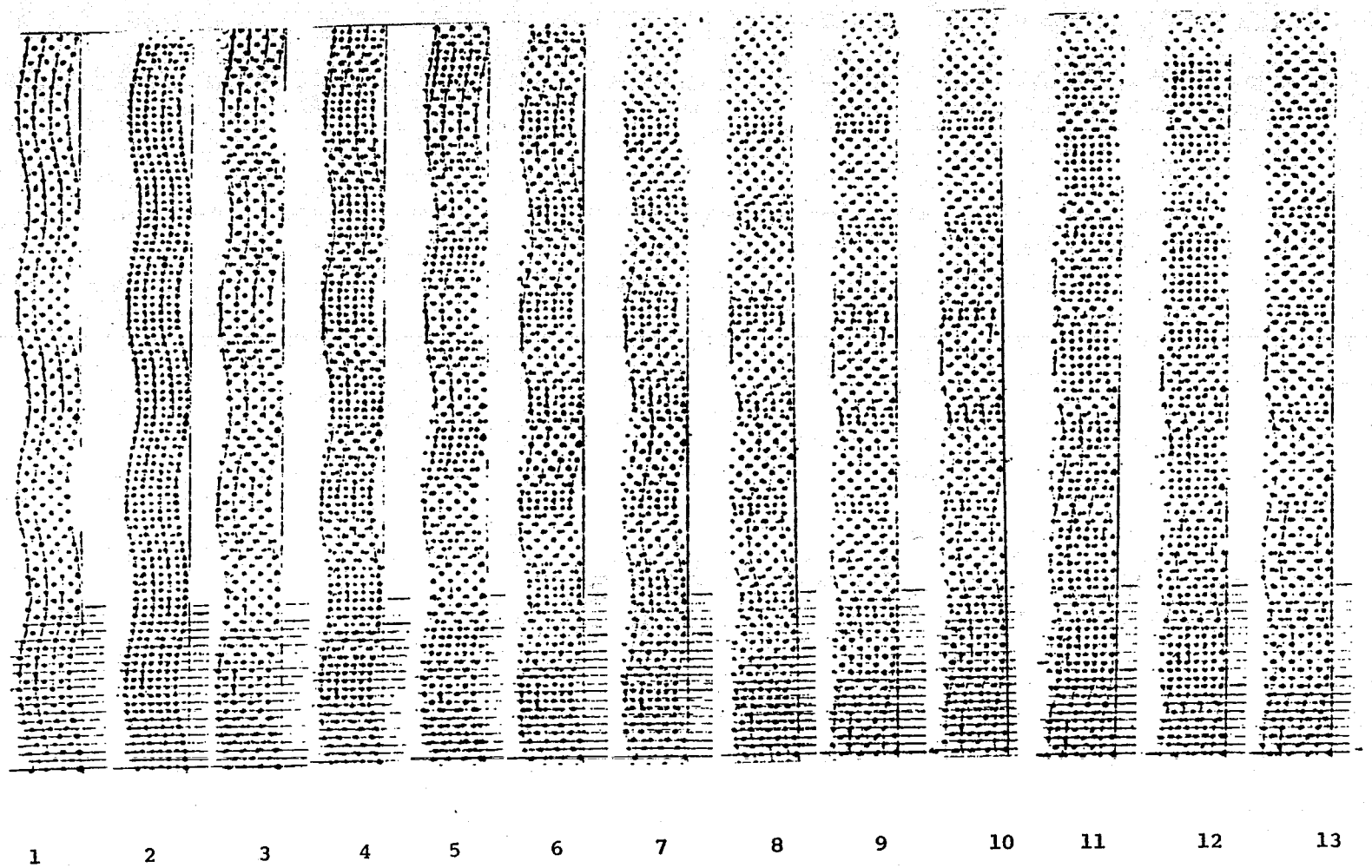

The basic pattern of item 1 of FIG. 1 was duplicated by taking a strip of embossed web, inking the individual elements and pencilling the theoretical sine wave that a given roll element follows. The sine wave is laid out in the MD direction. Note that elements are aligned in CD, and therefore, the pattern repeat is in small increments of approximately ⅛" throughout. Because of photographic and xerographic reduction error the repeat length on the illustrations may not precisely match the repeat length of the description.

The end product embossed according to the pattern of Example I showed on the web exactly as shown in item 1 of FIG. 1 when the web was withdrawn directly from the embosser. When, however, the web passed through the embosser and to the subsequent winding operation, a pronounced degradation of embossments showed up as alternating strips of variable length (MD), the strips traversing the full width of the base web material. Each of the series of strips (items 1 through 20 of FIGS. 1 and 1A) represent an overlay of one pattern on the other. Photographs were taken with strong light placed at the rear and shining through both sheets. For example, item 1 shows two identical strips laid one on top of the other in perfect synchronism and perfect repeat. This represents a condition where the web is perfectly nested. By moving the top strip a distance equal to one-half the distance between elements in any given line, a condition similar to item 2 is shown ehereby all embossments of the top strip are in perfect non-register with embossments on the bottom strip. This represents a condition where embossment of an outer convolution fall between and within embossments of the underlying convolution. In item 3, the top strip was shifted a distance equal to the distance between any two embossments in the same MD line, and herein begins an explanation of the phenomenon described as sequential nesting/non-nesting. It is noted that certain of the elements remain synchronized (nesting) while others are non-synchronized or non-nesting. It is understood that this strip or "band" effect happens across the entire web, that is, in transverse strips across the full width of the web as it passes through the embosser. For clarification, the narrow strips of superposed embossments are aligned in the direction of web travel (MD) as they would travel through the embossing and rewinding converting equipment.

In each of the subsequent items 4 through 20, it will be noted that the layout of elements on a theoretical sine wave with its neutral axis parallel to the MD results in, (as shown sequentially), a greater or lesser number of embossments that nest with the underlying strip or web, and also a greater or lesser number of embossments that assume the non-synchronous or non-nesting condition. Based on the fact that these elements were 0.070" deep, it was surmised that elements in the non-nesting condition collapsed and caused an undesirable and unsightly striped effect in cross-direction but variable in width in the machine direction, which was hard to distinguish from good embossments, especially when the roll diameter caused a pattern sketch shift similar to item 24 and its subsequent transitional change through items 1 and 2. Because of instantaneous changes in web tension, embossment failure does not necessarily follow the precise effect illustrated sequentially from item 1 through 20 and this made it even more difficult to relate to pattern repeat.

It was noted, however, both on the product roll, and in the experiments performed, that the failure of embossments would change abruptly from, for example item 23 to item 24—item 24 representing a shift of a top web equal to a full pattern repeat and thus being equal to the referenced starting point of item 1. Embossments per item 23 could be fully degraded until the embossments perfectly nested per item 24 (and item 1) but then would abruptly change into full degradation of item 2. At this point in time, the true relationship between pattern repeat and the problem of embossment failure was not recognized.

Figure 1A:
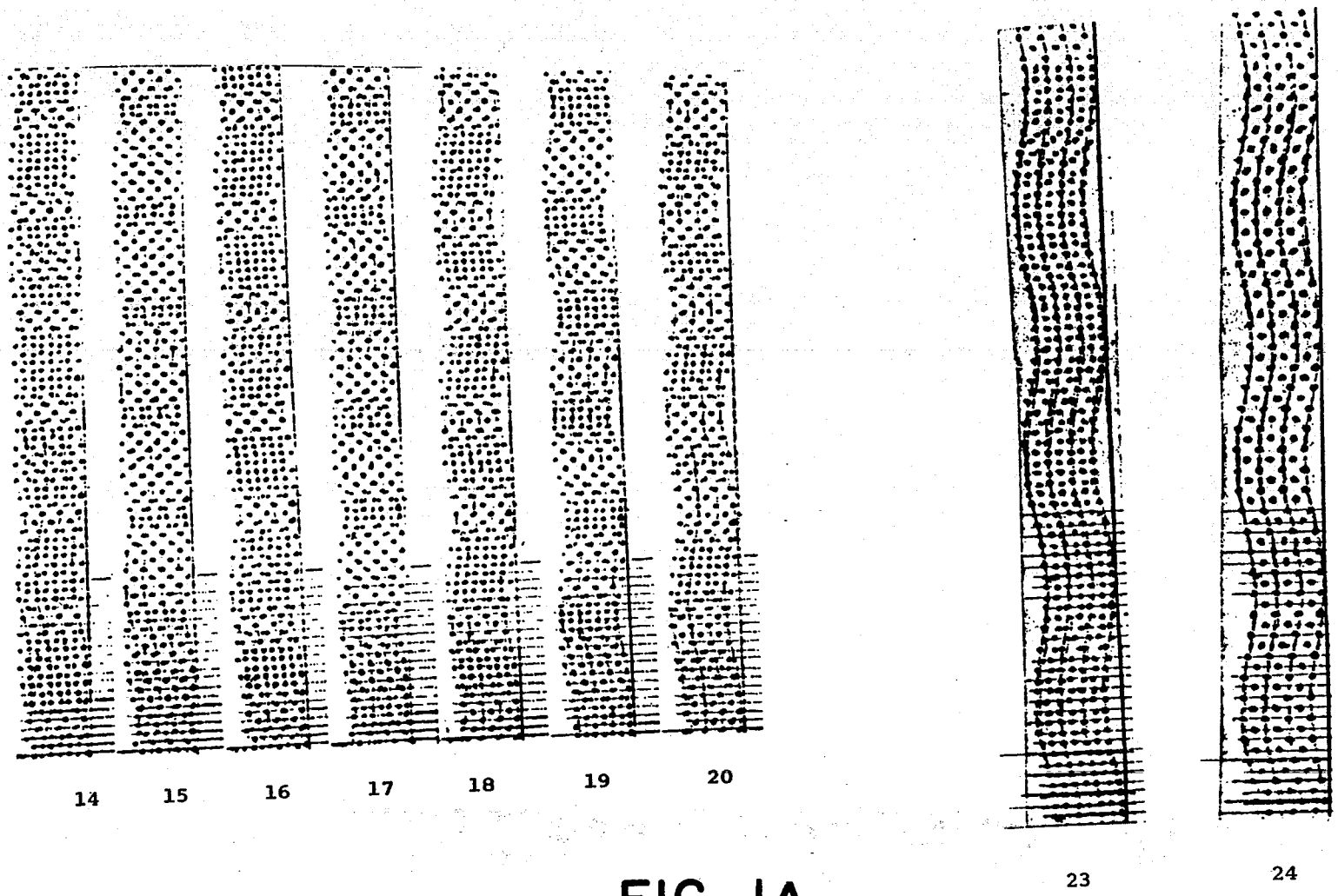
Figure 2:
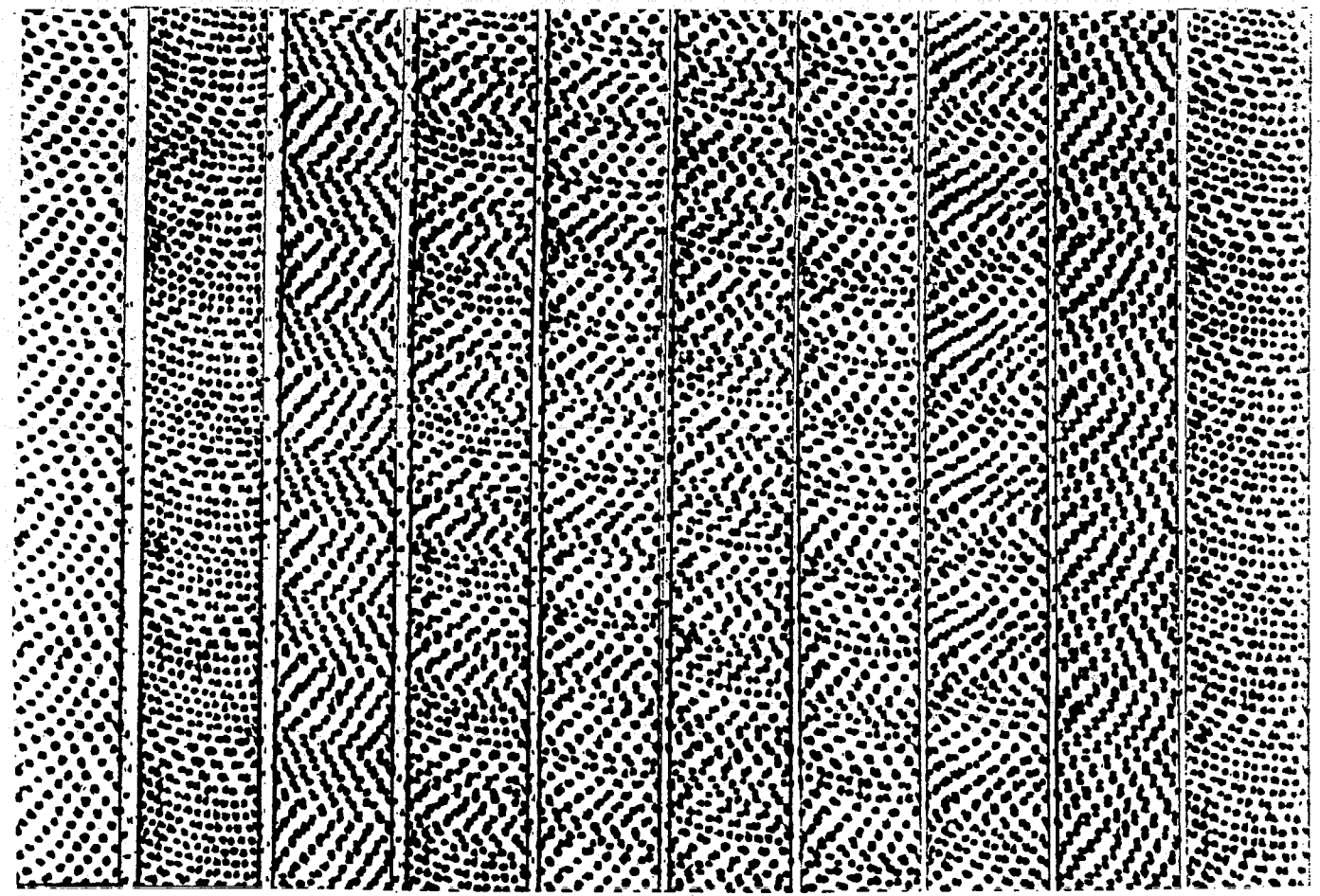
FIGS. 2, 2A and 2B (3 sheets) represent another sequence of photographs—according to Example II.
Figure 2A:
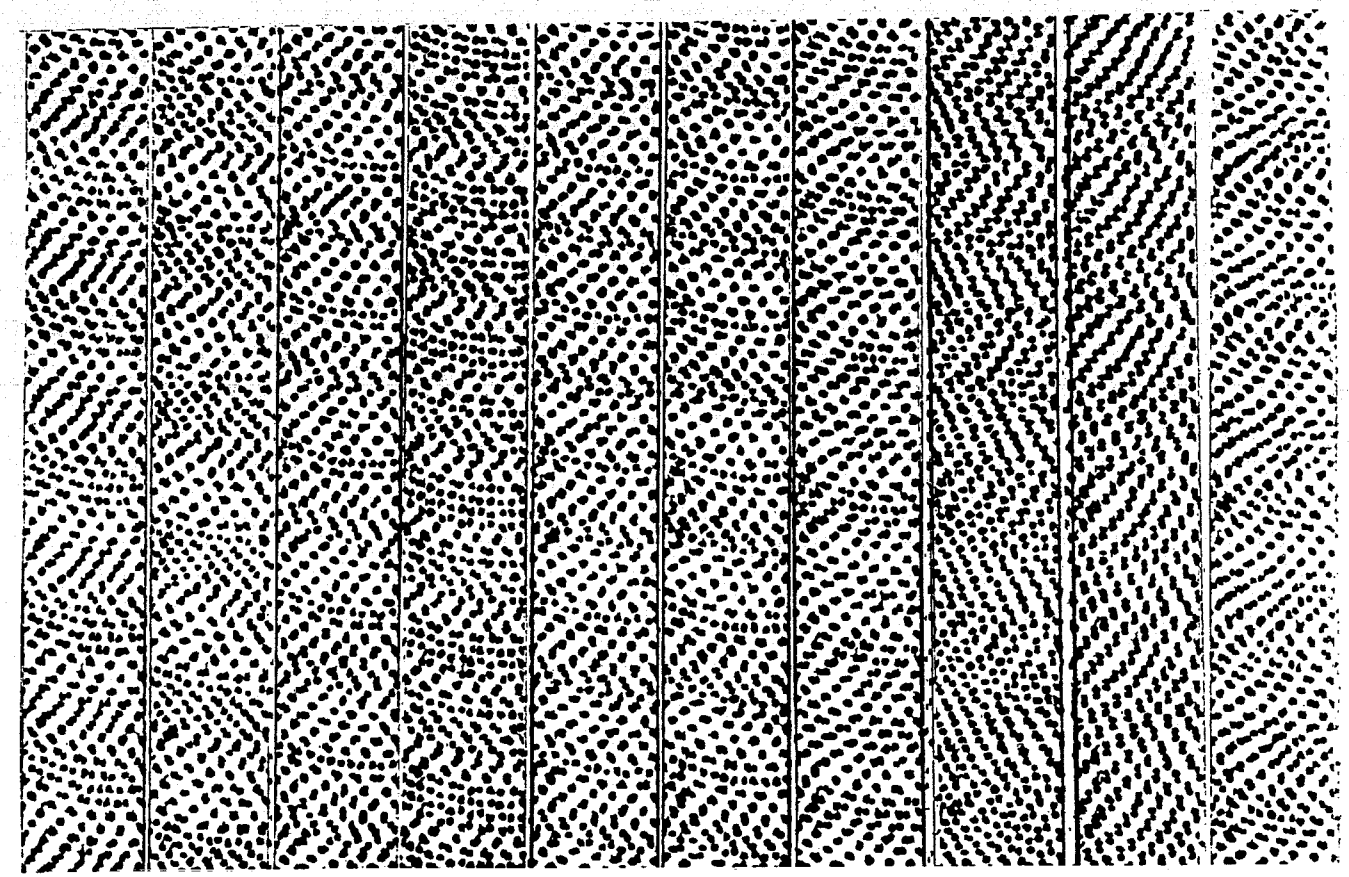

In the attempt to solve the problem for a customer using the pattern of FIGS. 1–1A, production trials were arranged using the customer's paper on a different converting line with a different pattern as reproduced in FIG. 2 and described in Example II.

EXAMPLE II

Figure 2B:
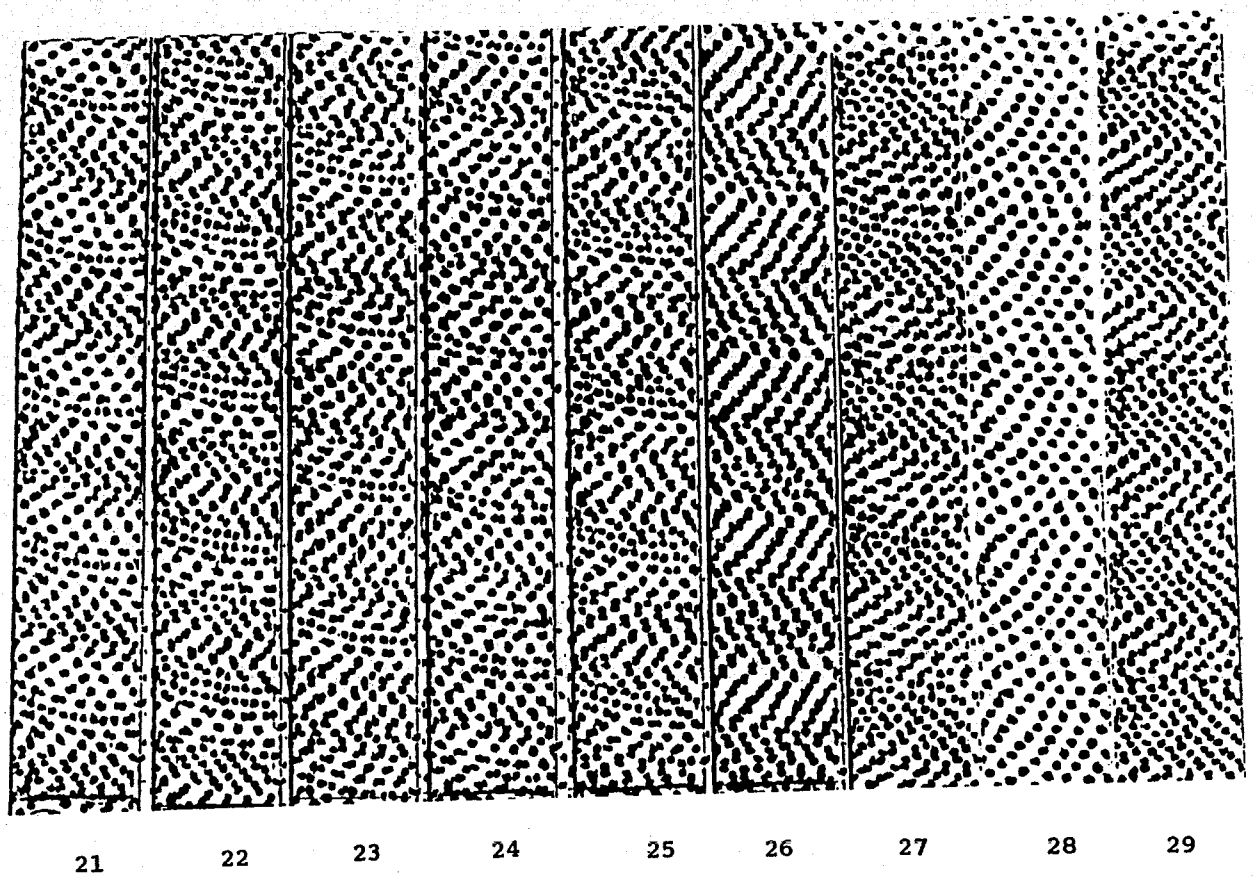

To obtain the illustrations of FIGS. 2–2B, the basic "pattern illustration" was generated by the above-described method of inking the tops of each embossment and xerographic methods. The fine dots inked on the absorbent web were then made more nearly round and the scale added before taking another xerographic copy. The scale is in convenient increments of $\frac{1}{8}$" and has no relationship to the placement of elements or embossments CD—it being noted that they are not perfectly aligned in the CD. In effect, this pattern represents what could be commonly referred to as a double sine wave.

The above-mentioned trials produced rolls where degradation of embossments again showed failure or collapsement of a variable number of elements in narrow (but variable) width bands that were substantially transverse to the direction of web travel.

Since the elements on the embossing roll of FIGS. 2–2B are not aligned perpendicular to web travel, the failure of elements across the full web width would not be noticeable in bands transverse the full web width, but rather in a full web width, the failures occurred at some acute angle to a transverse line and hence represented a different result when the full web was viewed between the embosser and the down stream rewinding operation.

The illustration of FIGS. 2–2B including the "base" and sequentially numbered strips 1 through 29 were achieved by photographic methods as described above for FIGS. 1–1A.

The base reference of FIG. 2 represents two strips superimposed so that dots (representative of embossments, or location of elements on the roll) are aligned, and thusly are in perfect nesting condition. In item 2, a small shift of $\frac{1}{8}$" in the MD direction shows that dots (dots and embossments being used interchangeably) of the top strip are now perfectly non-aligned or in non-synchronous relationship to the bottom strip and hence would represent a condition in a wound roll where embossments of an underlying convolution are out of register with embossments of the next wound convolution and therefore in non-nesting condition. Especially when the embossments are large or deep, these embossments tend to flatten out and cause pattern embossment degradation. Viewing FIGS. 2–2B sequentially from items 2 through 29, it will be noted that various nesting and non-nesting conditions occur through certain transitional phases of items 9 and 19 until the top strip (or outer convolution) has shifted relative to the bottom strip (or convolution) one full repeat length—as evidenced by item 28. The total shift from perfect nesting of the base pattern through all transitional phases to the perfect nesting of item 28 represented 28 shifts of 0.125" or a total shift of 3.5". When this sketch repeat of 3.5" was related to the diameter of the production roll as required by the engraver, and therefore related to the sketch repeat of much smaller diameter tooling, it established certain fundamental relationships that were used in further experiments and in the final discovery and conclusion of the inventive method.

To develop the theory that sequential nesting and non-nesting of the web was very instrumental to the collapse and destruction of embossments, I selected a standard pattern having a relatively small repeat, but with larger elements arranged symmetrically both in the MD and CD directions. Selecting a pattern with a larger embossment would be a clue and perhaps evidence that sequential nesting and non-nesting destroyed elements that were non-nested because of the pressure they had to sustain from over laying and outer convolutions of wound product. This is reflected in Example III.

EXAMPLE III

Figure 3:
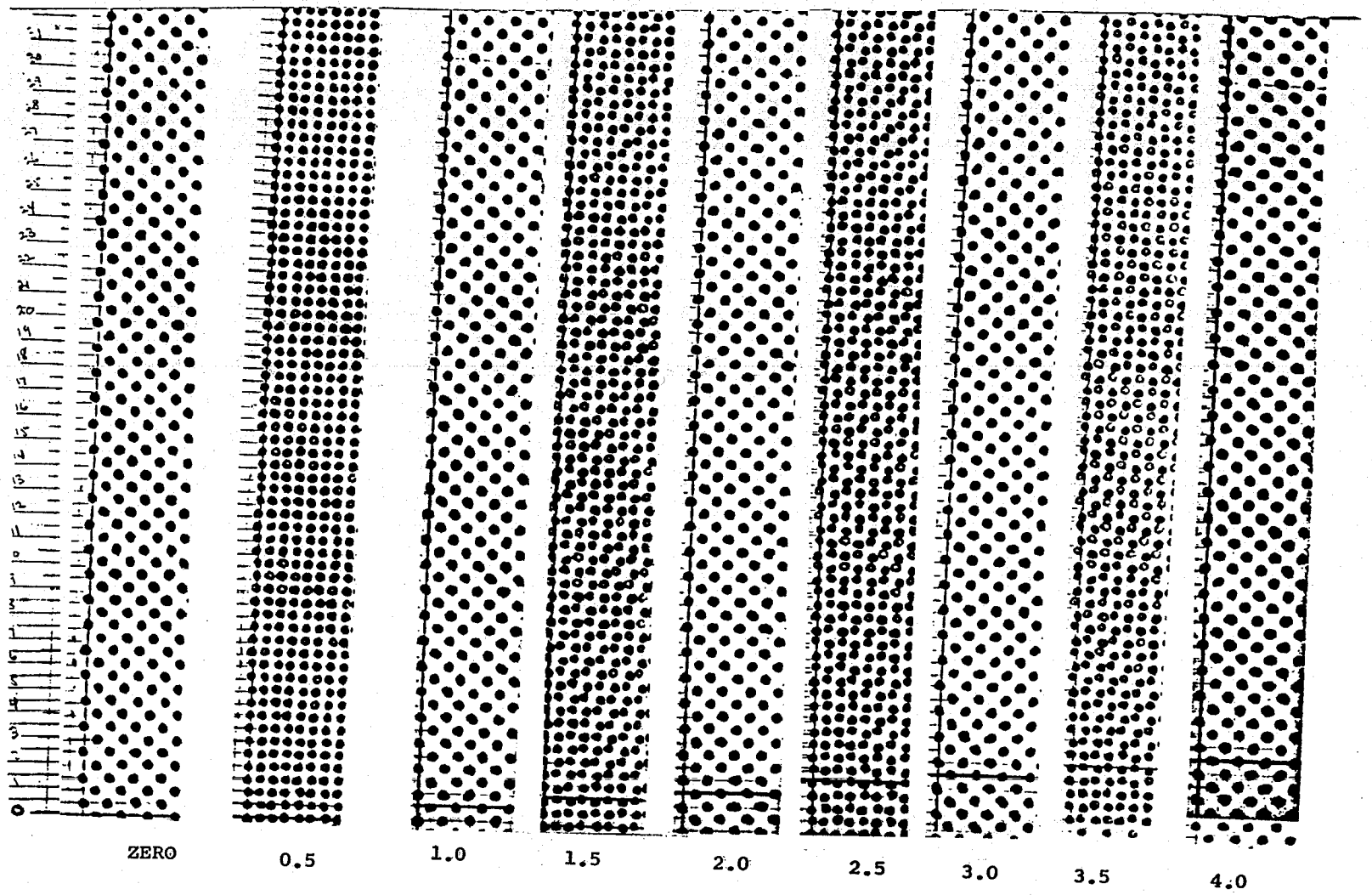
FIG. 3 is another sequence of photographs—according to Example III.

The pattern repeat of FIG. 3 is approximately 0.25". The illustration marked "zero" illustrates perfect alignment and perfect nesting when the embossments of two superposed webs are in perfect alignment. Item 0.5 represents a shift of $\frac{1}{2}$ sketch repeat or about 0.125" in the web direction, and clearly shows that embossments of the underlying web are perfectly out of phase and non-synchronous with dots of embossments of the top web. As expected, item 1.0 and each integer which represented a full pattern sketch shift are perfectly aligned, with intermediate items 1-5, 2.5, etc. perfectly misaligned. From inspection of the roll, it also became evident that the transition or shift from full nesting to non-synchronous arrangements happened in degrees, and in effect, caused parts of embossments to be collapsed, thus prompting an intermediate description of embossment failure—that is almost bad to almost good vs. the precisely good and precisely bad conditions illustrated sequentially by 1.0, 1.5, 2.0, 2.5.

Relative to FIG. 3 and recognizing that the illustration represented the extreme conditions, the next step was to unravel a roll of tissue product produced with this pattern discerning between "good and bad", i.e., "G" or "B". Solely a matter of judgment, good sheets were then removed, the roll diameter measured, and sequentially the same steps taken through the entire series of good and bad embossments. The Table following represents the summation of these findings.

| | No. of Sheets | Roll Count | Roll Dia. " | | No. of Sheets | Roll Count | Roll Dia. " |
|---|---|---|---|---|---|---|---|
| | Core | None | 1.695 | G | 2 | 138 | 3.010 |
| B | 7 | 7 | 1.810 | B | 10 | 148 | 3.090 |
| G | 1 | 8 | 1.840 | G | 2 | 150 | 3.100 |
| B | 13 | 21 | 1.960 | B | 9 | 159 | 3.160 |
| G | 1 | 22 | 1.980 | G | 3 | 162 | 3.180 |
| B | 3 | 25 | 2.000 | B | 6 | 168 | 3.125 |
| G | 1 | 26 | 2.015 | G | 4 | 172 | 3.250 |
| B | 2 | 28 | 2.045 | B | 8 | 180 | 3.300 |
| G | 1 | 29 | 2.052 | G | 2 | 182 | 3.325 |
| B | 5 | 34 | 2.090 | B | 10 | 192 | 3.390 |
| G | 1 | 35 | 2.105 | G | 3 | 195 | 3.420 |
| B | 4 | 39 | 2.140 | B | 7 | 202 | 3.460 |
| G | 3 | 42 | 2.175 | G | 3 | 205 | 3.480 |
| B | 6 | 48 | 2.240 | B | 9 | 214 | 3.530 |
| G | 1 | 49 | 2.250 | G | 4 | 218 | 3.560 |
| B | 8 | 57 | 2.325 | B | 7 | 225 | 3.600 |
| G | 1 | 58 | 2.330 | G | 8 | 233 | 3.655 |
| B | 5 | 63 | 2.385 | B | 6 | 239 | 3.695 |
| G | 1 | 64 | 2.390 | G | 6 | 245 | 3.730 |
| B | 1 | 65 | 2.400 | B | 5 | 250 | 3.770 |
| G | 1 | 66 | 2.415 | G | 7 | 257 | 3.810 |
| B | 1 | 67 | 2.420 | B | 7 | 264 | 3.850 |
| G | 1 | 68 | 2.425 | G | 5 | 269 | 3.890 |
| B | 3 | 71 | 2.450 | B | 7 | 276 | 3.940 |
| G | 2 | 73 | 2.475 | G | 7 | 283 | 3.965 |
| B | 7 | 80 | 2.535 | B | 5 | 288 | 4.005 |
| G | 3 | 83 | 2.570 | G | 10 | 298 | 4.065 |
| B | 6 | 89 | 2.618 | B | 6 | 304 | 4.110 |
| G | 1 | 90 | 2.625 | G | 7 | 311 | 4.140 |
| B | 1 | 91 | 2.630 | B | 6 | 317 | 4.165 |
| G | 1 | 92 | 2.640 | G | 7 | 324 | 4.215 |
| B | 5 | 97 | 2.680 | B | 4 | 328 | 4.230 |
| G | 5 | 102 | 2.730 | G | 8 | 336 | 4.285 |
| B | 4 | 106 | 2.750 | B | 7 | 343 | 4.315 |
| G | 2 | 108 | 2.765 | G | 7 | 350 | 4.355 |
| B | 8 | 116 | 2.835 | B | 5 | 355 | 4.385 |
| G | 2 | 118 | 2.850 | G | 6 | 361 | 4.430 |
| B | 9 | 127 | 2.930 | B | 6 | 367 | 4.500 |
| G | 3 | 130 | 2.950 | G | 13 | 380 | 4.540 |
| B | 6 | 136 | 3.000 | | | | |

Certain phenomena appeared during the course of this Example. For example, starting with the outside of the core diameter at 1.695, it was evident that the collapsed and unacceptable embossments greatly outnumbered sheets with good embossments near the core—reflecting the effect of inherent web tension and inherent memory of the stretched paper to assume its normal unstretched state—not unlike the effect in wound rolls of polyethylene whereby the wound tension can ultimately collapse the open center of a coreless wound roll. The table also suggests that from about 3" outward, the effect of inherent tension is less severe, and progressively less severe as you approach final roll diameter. Nonetheless, the table further suggest that, within the error of judgment, a series of good sheets will be followed by a series of bad sheets or, stated in other terms, a series of sheets will nest, and be followed by a series of sheets that do not nest.

As a result of the experiment in FIG. 3, a roll of commercially available product having embossments arranged in sine waves, both in MD and CD, was selected for review. This is reflected in Example IV below.

EXAMPLE IV

Figure 4:
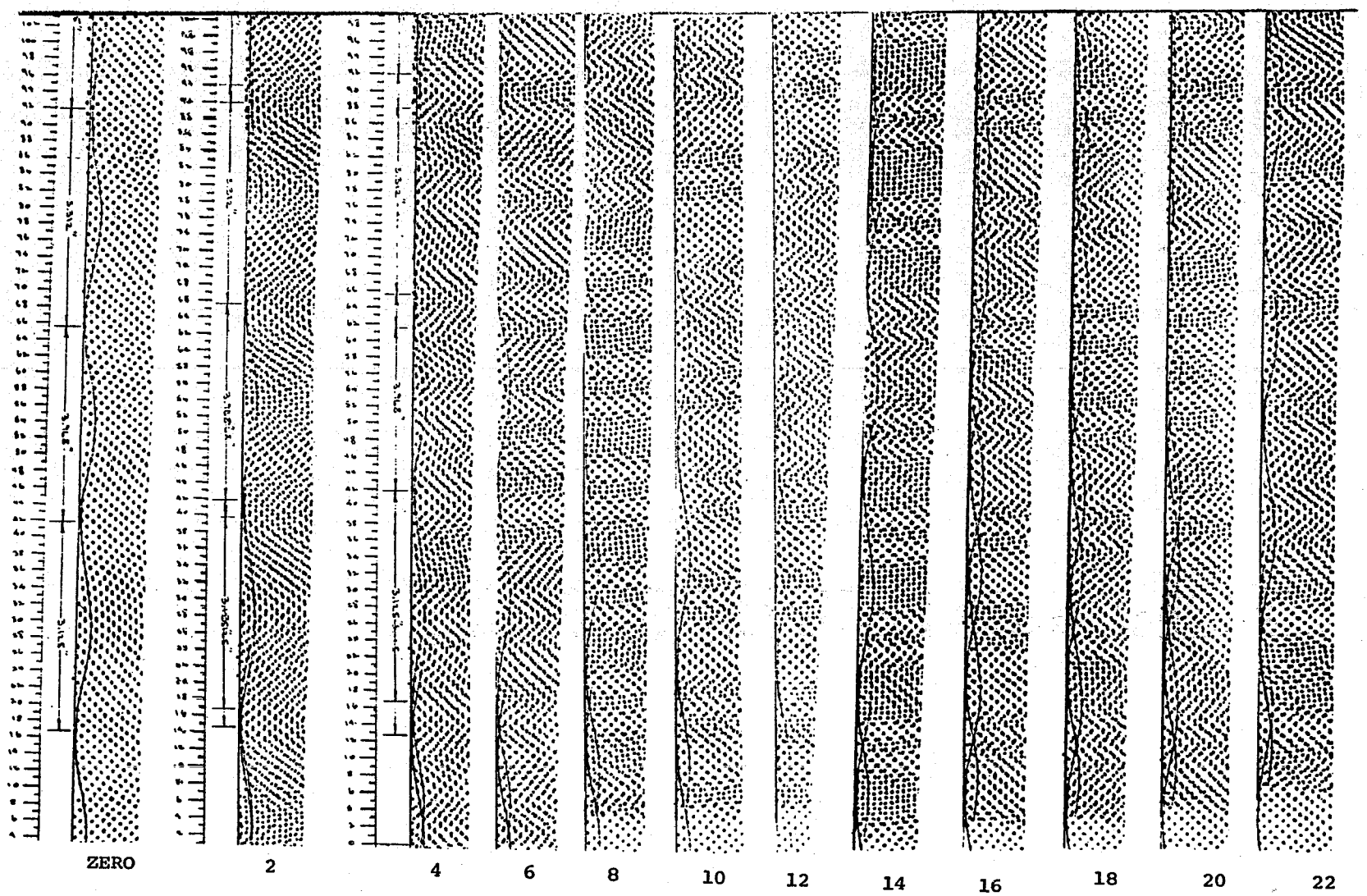
FIG. 4 is another sequence of photographs—according to Example IV.

Item 1 of FIG. 4 is a representation of the pattern from the commercial sample, inked as described above, and further "clarified" by rounding the elements with pencil. Xerographic methods also were used throughout this Example. A sine wave was pencilled between elements, and in item 1, it is noted that the pattern sketch repeat is sequentially 3.1875"-3.312"-2.968" and 3.125". The embossments were made with a master roll and in turn, engraver's tooling with the same repeats, the tooling was 4-time, that is, at least 12.59" circumference. However, it is noted that the average sketch repeat is 12.59 divided by 4 or 3.148".

In item 2 of FIG. 4, an overlay was shifted one sketch repeat—as evidenced by the unreadable dimensions and mismatched embossments in the second, third, fourth repeats . . . etc. In item 3 of FIG. 3, the overlying strips were shifted two repeats with results per the above comment. The zero reference shows two strips precisely overlayed to simulate a perfect nesting condition, with the scale left intact for alignment. Any small mismatch of scale marks, etc. is simply due to scaling and drawing inaccuracy or photo reduction error, etc.

Item 2 shows one of the two superposed webs shifted 0.250" in the web direction, and items 4 through 22 (FIGS. 4A and 4B) each represent one additional shift register of 0.250". From these results, it was concluded that even with large tooling and a relatively large sketch repeat in the range of 3 to 5" would continue to yield sequential nesting and non-nesting with the sequential destruction of elements.

Figure 5:
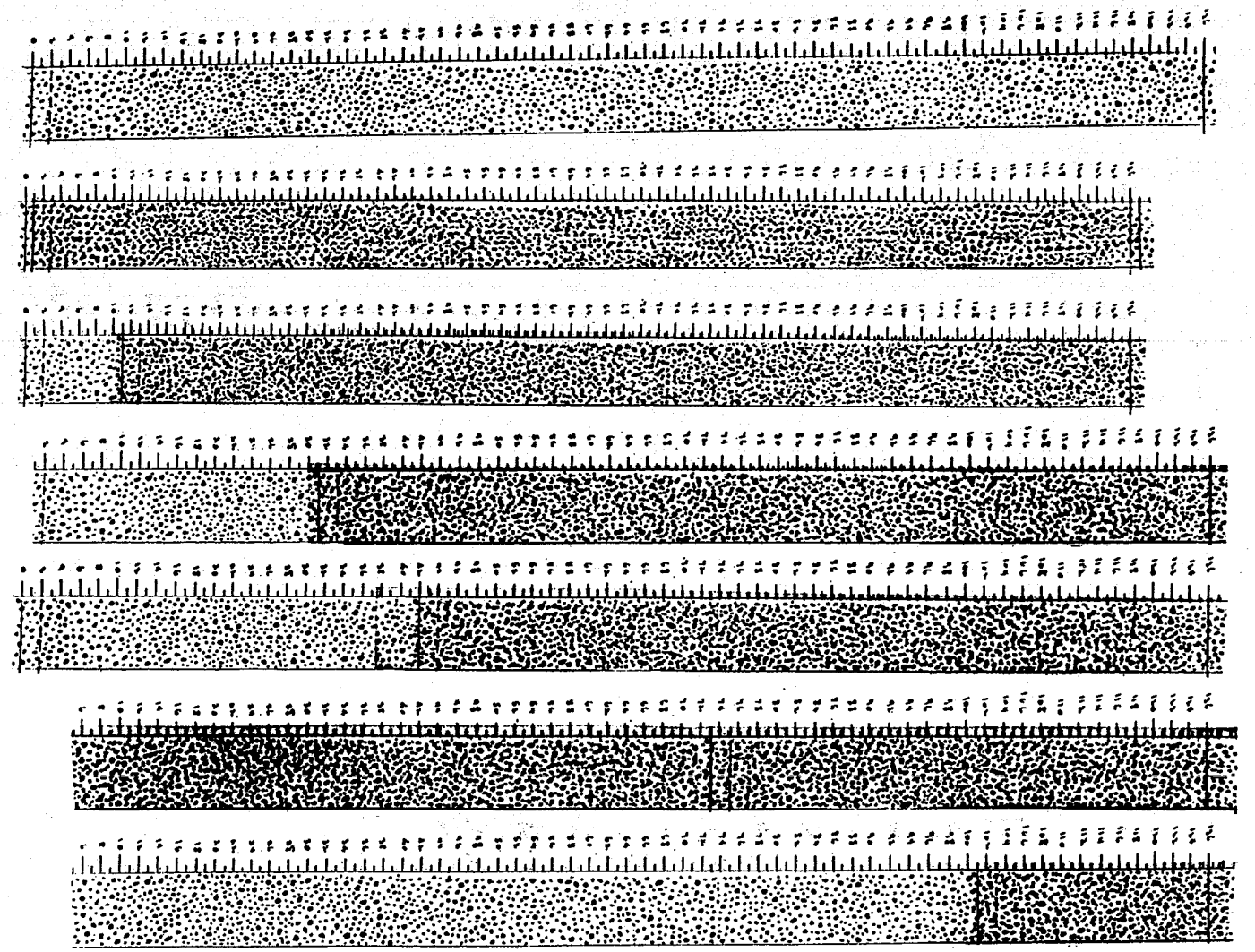
FIG. 5 is yet another sequence of photographs—according to Example V.

It was at this point where the inventive discovery occurred and subsequent illustrations of FIGS. 5 give proof of discovery. In essence, this invention resides in the requirement that a pattern repeat must be equal to or greater than the circumference of the finished roll in order to avoid any semblance of nesting. To the best of my knowledge there are none and have been no convolutely wound products embossed according to this disclosure.

EXAMPLE V

The "zero" reference of FIG. 5 shows a randomized pattern having a repeat of approximately 17.25" and this length according to the inventive disclosure would insure that the pattern will not nest throughout a range of roll diameters up to approximately 5.5". It is understood that this specific dimension can change, depending on the final desired diameter, albeit sanitary tissue products like roll tissue and toweling are normally limited to under 6" diameter in the commercial markets.

To prove that the pattern does not nest over this range, the illustrations of FIG. 5 include a zero reference which is representative of perfect synchronization and nesting. The randomized pattern and the effective shifting was evaluated in several series as represented by superposed strips and incremental shifting in 104 groups of which only representative ones are presented, viz., zero, 1, 11, 32, 42, 71 and 101 in order to conserve on space.

I have found that even with a randomized pattern similar to FIGS. 1, 2, and 4, there will be nesting and embossment breakdown unless the pattern repeat length is at least equal to the finished roll circumference as in FIG. 5—that is, with the embossing rolls having at least one pattern repeat (extended) length, it being understood that the circumference of the embossing roll can be made to have a multiple or integral number of these "extended" pattern repeats on its surface.

It will be recognized that FIG. 5 shows a randomized pattern having a sketch repeat greater than the circumference of the roll in order to avoid the problems discussed herein, but within the scope of this invention, other pattern arrangements and embodiments are possible. For example, within the "extended" sketch repeat as defined, one could intermingle a standard short repeat pattern therein without disrupting the desirable end results of a non-nested product, albeit the smaller pattern within the large pattern might contact embossments of the small pattern in the underlying convolution, etc.

The basic concept of randomizing the pattern over an extended repeat length is valid for describing the non-nested product as long as the randomized pattern represents the major portion of the embossments and hence provides the major portion of the support needed to keep embossments from being crushed or degraded.

Likewise, it is understood that the extended length patterns described herein can be interspersed between standard short repeat length patterns to create different aesthetic results, and further, it is within the scope of this disclosure to include different randomized patterns interspersed between standard small repeat patterns as long as the interspersed patterns are randomized and have a repeat length greater than the circumference of the finished roll product.

Also within the scope of the invention is the embossing separately of each web of a laminated product. Two webs joined together with embossments facing each other are not unlike nested embossing as in U.S. Pat. No. 3,867,225—but with substantial unembossed areas on both sides of the two-ply web, the composite is not subject to the same nesting-non-nesting phenomenon. Nonetheless, this may be an advantageous approach especially in rubber to steel combination coacting rolls since it would avoid the normal situation where harsh embossment peaks occur on one side of the web and at the same time should allow use of relatively small sized embossments that will not degrade when a certain proportion of the inwardly facing embossments contact each other.

Phrased another way, the art has had to put up with the nesting-non-nesting phenomenon in variable and unpredictable ways. In some instances, this may be tolerable. However, according to the invention, this undesirable phenomenon can be completely avoided. However, it will be appreciated that something less than perfection may still be useful—when the departure or slight degradation from perfection is consciously adopted. Thus, some of the variations from the ideal should still be considered within the spirit and scope of the invention because of the conscious departure from the ideal and the realization that somewhat diminished advantages or benefits are still attractive. Therefore, a great variety of apparatus can be utilized advantageously, i.e., rubber-steel co-acting rolls, paper-steel co-acting rolls, steel-steel co-acting rolls and where the co-acting rolls are of different diameter.

While in the foregoing specification a detailed description of the invention has been set down for purposes of illustration and explanation, many variations in the details hereingiven may be made by those skilled in the art without departing from the spirit and scope of the invention.

I claim:

1. A method for embossing a convolutely wound roll to avoid nesting comprising the steps of embossing web material with co-mating rolls having a pattern repeat in the machine direction at least equal to the circumference of the finished roll.

2. The method of claim 1 in which each of said co-mating rolls has an integral number of pattern repeats.

3. The method of claim 1 in which said co-mating rolls are constructed of steel.

4. The method of claim 1 in which the pattern is substantially random.

5. The method of claim 4 in which the pattern includes a number of different size embossments.

6. The method of claim 5 in which the pattern embossments is substantially similar to that of FIG. 5.

7. The finished roll produced according to claim 1.

8. The method of claim 1 in which the said web material is a paper web.

9. The method of claim 7 in which the finished roll is a roll of toilet tissue.

10. The method of claim 7 in which the said finished roll is a roll of kitchen toweling.

11. The method of claim 1 in which said co-acting rolls are rubber-steel.

12. The method of claim 1 in which said co-acting rolls are paper-steel.

13. The method of claim 1 in which each of the co-acting rolls have a circumference equal to an integer of the pattern repeat.

14. The method of claim 13 in which each of the co-acting rolls are of different diameter.

15. The method of claim 1 in which a small repeat pattern is surrounded by a randomized plurality of embossments, said plurality having a sketch repeat greater than the circumference of the finished roll product.

16. The method of claim 1 in which randomized patterns having a sketch repeat length greater than the circumference of the finished product roll are interspersed between MD strips of small repeat patterns.

17. A convolutely wound roll comprising web material wound on itself and having a pattern of embossments arranged in a repeat pattern, said repeat pattern having a length at least equal to the circumference of the finished roll and wherein the embossments of any top convolutely wound web sheet will be substantially displaced from the embossments of the underlying sheet.

* * * * *